United States Patent [19]

Hafner et al.

[11] Patent Number: 4,747,384

[45] Date of Patent: May 31, 1988

[54] FUEL INJECTION SYSTEM

[75] Inventors: Udo Hafner, Lorch; Heinrich Knapp, Leonberg 1; Rudolf Sauer, Benningen, all of Fed. Rep. of Germany

[73] Assignee: Robert Bosch GmbH, Stuttgart, Fed. Rep. of Germany

[21] Appl. No.: 933,959

[22] Filed: Nov. 24, 1986

[30] Foreign Application Priority Data

Feb. 12, 1986 [DE] Fed. Rep. of Germany ..... 3604392

[51] Int. Cl.[4] ..... F02M 51/08; F02M 61/14

[52] U.S. Cl. ..... 123/470; 239/125; 239/585

[58] Field of Search ..... 123/470, 472, 514, 516; 239/124, 125, 397.5, 585, 600

[56] References Cited

U.S. PATENT DOCUMENTS 3,841,277 10/1974 Schäfer ..... 123/470
4,235,375 11/1980 Melotti ..... 123/516 X
4,341,193 7/1982 Bowler ..... 123/516 X
4,416,238 11/1983 Knapp et al. ..... 123/470
4,531,678 7/1985 Knapp ..... 239/533.3
4,601,275 7/1986 Weinand ..... 123/516 X

*Primary Examiner*—Tony M. Argenbright
*Assistant Examiner*—Eric R. Carlberg
*Attorney, Agent, or Firm*—Edwin E. Greigg

[57] ABSTRACT

A fuel injection system for internal combustion systems is proposed, which serves to inject fuel into the intake tube of the engine. The fuel injection system includes at least one fuel injection valve which is disposed in the interior of a holder and communicates with both a fuel supply line and a fuel drainage line. The inflow of fuel into the fuel injection valve takes place radially via an inflow region. An orifice body is secured in the holder, forming a reservoir preceding the inflow region. In the first few seconds after hot starting of the engine, only the fuel stored in the reservoir reaches the inflow region and hence is injected. Because readily volatile fuel components have evaporated beforehand, the fuel stored in the reservoir enables especially good fuel preparation.

12 Claims, 1 Drawing Sheet

FUEL INJECTION SYSTEM

BACKGROUND OF THE INVENTION

The invention is based on a fuel injection system as defined hereinafter. From German Offenlegungsschrift No. 31 02 853, a fuel injection system is already known in which the fuel flowing via a fuel supply line to the injection valve and the excess fuel carried away from the injection valve via a fuel return line partly flushes the valve housing, for the sake of improved cooling.

In hot starting of an internal combustion engine equipped with this type of injection valve, the formation of fuel vapor bubbles can cause difficulties in starting particularly if fuel that includes vapor bubbles is ejected in the first few seconds after starting. These difficulties are due to the severe leaning down of the thereby formed fuel-air mixture and its attendant poor ignition performance.

OBJECT AND ADVANTAGES OF THE INVENTION

The fuel injection system according to the invention has the advantage over the prior art that by forming a reservoir of fuel free of vapor bubbles, an adequate supply of fuel to the injection valve and hence good ignition performance of the fuel ejected through the injection valve can be assured even in the first few seconds after hot starting. The object of the invention is attained based on the recognition that even though it is not practicable to prevent some fuel components from evaporating, still this effect of evaporation should at least be advantageously exploited.

In a particularly advantageous feature of the invention, the reservoir that stores the viscous fluid is embodied in the interior of an insert located between the injection valve and the holder that receives the injection valve. By means of this insert, the quantity of heat transferred from the holder to the injection valve, which contributes substantially to the evaporation of fuel, is reduced.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
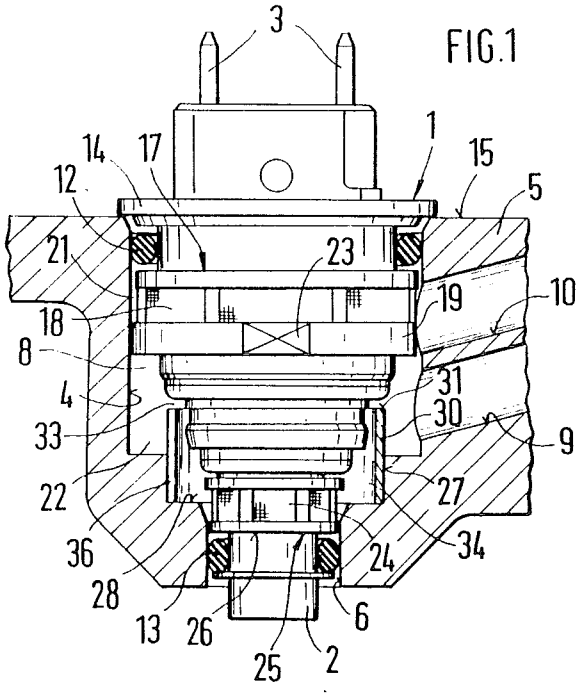
FIG. 1 shows generally in cross-section an exemplary embodiment of the fuel injection system according to the invention.

The fuel injection valve 1 shown in FIG. 1 is electromagnetically actuatable in a known manner and serves for example to inject fuel via a nozzle body 2, in particular at low pressure, into the air intake tube of mixture-compressing internal combustion engines having externally supplied ignition. The injection of fuel through the fuel injection valve may be effected either simultaneously for all cylinders of the engine upstream or downstream of a throttle valve into the air intake tube through a single fuel injection valve, or through respective fuel injection valves into the individual air intake tubes immediately upstream of each inlet valve of each cylinder of the engine. The electrical triggering of the fuel injection valve 1 may be effected in a known manner via contact pins 3. The fuel injection valve 1 is supported in a first guide opening 4 of a holder 5, in its region remote from the nozzle body 2, and in a second guide opening 6 of the holder 5 in its region located near the nozzle body 2. The first 4 and second 6 guide openings are suitably located coaxially with one another, and the second guide opening has a smaller cross section than the first guide opening 4. The holder 5 may be embodied by the air intake tube wall itself, or as an independent part. For supplying fuel, a fuel supply line or fuel supply opening 9 is used, extending inside the holder 5 and discharging into an interior 8 formed by the first 4 and second 6 guide openings; for removing excess fuel, a fuel drainage line 10 that also extends inside the holder 5 and discharges into the interior 8 is used. As shown in the drawing, the fuel supply line 9 is located below the fuel drainage line 10 and thus closer to the nozzle body 2. The supporting of the fuel injection valve 1 in the first 4 and second 6 guide bore as shown is effected with the interposition of respective seals 12, 13, one for each guide bore, between the fuel injection valve 1 and the holder 5. In this manner, the interior 8 and the atmosphere of the intake tube receiving the holder 5 are sealingly separated from one another. In the direction remote from the nozzle body 2, the fuel injection valve 1 has a rim 14, which has a diameter greater than the diameter of the first guide bore 4 and which with the fuel injection valve 1 is supported on an outer shoulder 15 of the holder 5. The fuel injection valve 1 also has a first filter ring 17 arranged to rest on the circumference of, or forming part of, the injection valve 1. This first filter ring 17 has flow openings 18, through which the fuel can leave the fuel injection valve 1. The first filter ring 17 is disposed on the fuel injection valve 1 and inside the interior 8 of the holder 5 in such a way that the flow openings 18 communicate with the fuel drainage line 10. In the direction oriented toward the nozzle body 2, adjoining the first filter ring 17, is a collar 19 which extends preferably as far as the wall of the first guide bore 4 and thus forms a part of either the fuel injection valve 1 or the first filter ring 17. This collar 19 divides the interior 8 into two partial chambers: a first partial chamber 21, which communicates with the fuel drainage line 10, and a second partial chamber 22, which communicates with the fuel supply line 9 and is sealed off from the atmosphere of the intake tube by the seal 13. Throttle openings 23 are machined into the circumference of the collar 19, so that an overflow of fuel under pressure from the first partial chamber 22 into the second partial chamber 21 is possible only with a pressure drop. The throttle openings 23 can be embodied approximately as flattened areas formed by removal of material from the circumference of the collar 19.

By means of a second filter ring 25 which surrounds the fuel injection valve 1 in an inflow region 24 near the nozzle body 2 and located inside the second partial chamber 22, the fuel flowing via the inflow region 24 into the fuel injection valve 1 is cleansed of dirt particles. The second filter ring 25 may simultaneously serve to assure the axial positional displacement of the seal 13, in that an axial displacement of the seal 13 in the direction remote from the nozzle body 2 is limited by a shoulder 26 on the second filter ring 25. In a first exemplary embodiment of the invention, shown in FIG. 1, a blind bore 27 disposed coaxially with the first 4 and second 6 guide bores is located on the bottom of the first guide opening 4, and its diameter is accordingly smaller than that of the first guide opening 4 but larger than that of the second guide opening 6. An orifice body 30, preferably in the form of a cylindrical ring having a slight wall thickness, rests on the bottom 28 of the blind bore 27, and over a portion of its axial length it is surrounded by the wall of the blind bore 27 while in the region of its remaining axial length it protrudes coaxially into the second partial chamber 22 of the interior 8 to such a distance that a flow region in the form of an overflow gap 33 remains between a limiting wall 31 of the orifice body 30 remote from the nozzle body 2 and the wall of the fuel injection valve 1. The orifice body 30 may be of metal, plastic, or a ceramic material.

Of the fuel delivered via the fuel supply line 9, some, after flowing through or flushing the second partial chamber 22, reaches the overflow gap 33 and from there flows inside the orifice body 30 to the second filter ring 26, and after flowing through it the fuel reaches the inlet region 24 of the fuel injection valve 1. The volume enclosed by the orifice body 30 and that which surrounds a portion of the fuel injection valve 1, and also defined by the bottom 28 of the blind bore 27, will hereinafter be termed the "thick-juice reservoir" 34. The term "thick juice" is used by those skilled in the art to mean the fuel from which the more readily volatile components have evaporated. Because this fuel has a higher boiling point, it has less of a tendency to form vapor bubbles than does fuel of a normal consistency. Only in this way is exact metering of the fuel quantity possible during hot starting, because vapor bubbles are now no longer capable of affecting the metering.

The function of the thick-juice reservoir 34 is as follows:

After an engine equipped with the fuel injection system according to the invention is shut off after running at high temperature, there is a pronounced thermal action at the surface of the injection valve 1 and holder 5 upon the fuel now located unmoving in the thick-juice reservoir 34, because the cooling action of the fresh fuel flowing in during operation by way of the fuel supply line 9 is absent. The result is heating of the fuel located in the thick-juice reservoir 34 and evaporation of the more readily volatile components of the fuel, which because of their lower specific gravity rise and flow into the second partial chamber 22 via the overflow gap 33. This vapor bubble formation is still further promoted by the decreasing pressure in the fuel supply line 9, and hence in the thick-juice reservoir 34 as well, that occurs after the engine is shut off. From there, the next time the engine is started the fuel flows via the throttle openings 23 to the fuel drainage line 10. After some time, all the more readily volatile fuel components inside the thick-juice reservoir 34 have evaporated; what is left is the thick juice. If hot starting of the engine now takes place, then for the first few seconds after starting it is precisely this thick juice that is ejected through the fuel injection valve 1, rather than the fuel partly containing vapor bubbles that is located outside the thick-juice reservoir 34, in the second partial chamber 22. As a result, the readiness of the prepared fuel/air mixture to ignite is assured from the start. Once the supply of thick juice in the thick-juice reservoir 34 has been used up, then the cool fuel pumped by a fuel pump (not shown) increasingly reaches the fuel injection valve 1 via the fuel supply line 9. A suitable transition from the supply of thick juice to the supply of regular fuel can be attained by a suitable selection of the size of the thick-juice reservoir 34.

The orifice body 30 may have a slit 36 extending in the longitudinal direction, preferably in its region remote from the fuel supply line 9. This facilitates insertion of the orifice body 30 into the blind bore 27. To this end, before insertion of the orifice body 30 into the blind bore 27, the orifice body 30 is compressed, so that the faces that form them between the slit 36 contact one another; the orifice body 30 is then inserted in this state into the blind bore 27 and then relaxed, as a result of which it rests with its outer jacket against the wall of the blind bore 27.

Figure 2:
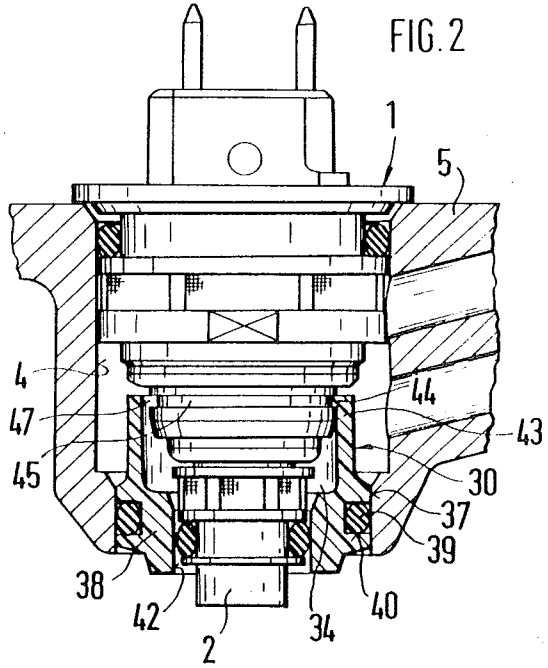
FIG. 2 also shows generally in cross-section a second embodiment according to the invention.

A second exemplary embodiment of the invention is shown in FIG. 2. Elements functioning the same as those in FIG. 1 are identified by the same reference numerals. As compared with FIG. 1, the embodiment of FIG. 2 lacks the blind bore 27 and the second guide opening 6. Instead, there is a through bore 37, which is of equal or lesser diameter than the diameter of the first guide opening 4, located in the lower portion of the holder 5 oriented toward the nozzle body 2. Between this through bore 37 and the fuel injection valve 1, there is a rotationally symmetrical insert 38, which is sealed off with respect to the through bore 37 by a ring seal 39 guided in a groove of the insert 38. Inside the insert 38 is an opening 42, which is embodied in such way to function in the same manner as the second guide opening 6 of the exemplary embodiment of FIG. 1. In the direction remote from the nozzle body 2, the orifice body 30, as part of the insert 38, extends spaced apart from the fuel injection valve 1. The orifice body 30 does not terminate in a limiting rim 31 which forms an overflow gap, as in FIG. 1, for example, but instead terminates on a portion of its circumference in at least two inwardly curved detent sections 43. The detent sections 43 snap, with protrusions 44, into a retaining groove 45 which is machined into the circumference of the fuel injection valve 1. Between each two adjacent detent sections 43 or protrusions 44 are flowthrough regions 47, which in their function correspond to the overflow gap 33 of the first exemplary embodiment and consequently effect the communication between the fuel supply line 9 and the thick-juice reservoir 34 formed inside the orifice body 30.

In addition to the advantages already mentioned in conjunction with the first exemplary embodiment of the invention, the exemplary embodiment shown in FIG. 2 has the additional advantage of good thermal insulation between the holder 5 and the fuel injection valve 1 because of the insert 38 located between them. This is particularly true if the insert 38 is of a material with low thermal conductivity, such as plastic. This insulating effect of the insert 38 affords the advantage that the heat of the holder 5 does not directly reach the vicinity of the fuel injection valve 1, where it would promote the undesired formation of vapor bubbles. The two advantages of the insert 38 - good thermal insulation and storage of fuel in the thick-juice reservoir 34 - advantageously complement one another: By means of the insulating action of the insert 38, excessive heating of the fuel stored near the valve is avoided, and hence the possible evaporation of fuel components is avoided as well; but also, since this is often insufficient, the orifice body 30 assures that vapor bubbles forming in the thick-juice reservoir 34 can escape via the flowthrough regions 47 on the orifice body 30 in the above-described manner, without causing a fuel flow in the reverse direction, that is, into the thick-juice reservoir.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection system for internal combustion engines comprising an air intake tube and at least one fuel injection valve having at least one wall disposed in a guide bore, a nozzle body that serves to inject fuel into said air intake tube, said fuel injection valve and guide bore arranged to define an interior which is supplied with fuel through a fuel supply inlet opening, an orifice body (30) arranged to surround a portion of said fuel injection valve (1) in a spaced-apart manner, said orifice body, (30) including a terminal end in a direction extending upwardly away from said nozzle body (2) in the vicinity of said at least one wall of said fuel injection valve (1), thereby forming an annular flow-through region (33, 47) with the fuel injection valve (1), a filter (24) upstream from said nozzle having a portion thereof that extends into an area surrounded by a portion of said orifice body, and said terminal end of said orifice body and flowthrough region is located in an axial direction above said fuel supply inlet opening whereby fuel must flow upward from said inlet opening into said orifice body.

2. A fuel injection system as defined by claim 1, in which said orifice body (30) comprises a follow cylinder.

3. A fuel injection system as defined by claim 2, in which said orifice body (30) further includes a portion which is slit longitudinally.

4. A fuel injection system as defined by claim 1, in which said orifice body (30) is disposed in a bore (27) which is contiguous with the guide bore (4, 6).

5. A fuel injection system as defined by claim 1, in which said guide bore (4, 6) is embodied in a holder means (5) that protrudes into said air intake tube.

6. A fuel injection system as defined by claim 4, in which said guide bore (4, 6) is embodied in a holder means (5) that protrudes into said air intake tube.

7. A fuel injection system as defined by claim 1, in which said guide bore (4, 6) is embodied in a wall of the air intake tube.

8. A fuel injection system as defined by claim 4, in which said guide bore (4, 6) is embodied in a wall of the air intake tube.

9. A fuel injection system for internal combustion engines comprising an air intake tube and at least one fuel injection valve having at least one wall disposed in a guide bore, a nozzle body that serves to inject fuel into said air intake tube, said fuel injection valve and guide bore arranged to define an interior which is supplied with fuel through a fuel supply opening, an insert (38) which is positioned between a portion of the fuel injection valve (1) and a bore (37) contiguous with the guide bore (4, 6), an orifice body (30) formed by a portion of said insert and arranged to partly surround said fuel injection valve (1) in a spaced-apart manner, said orifice body (30) arranged to terminate in a direction extending upwardly away from said nozzle body (2) in the vicinity of said at least one wall of said fuel injection valve (1), thereby forming at least one flowthrough region (33, 47) with the fuel injection valve (1).

10. A fuel injection system as defined by claim 9 in which said orifice body further includes a plurality of detents (43) said detents being provided with inwardly directed protrusions (44), which snap into a retaining groove (45) machined into said fuel injection valve (1).

11. A fuel injection system as defined by claim 9 in which said guide bore (4, 6) is embodied in a holder means (5) that protrudes into said air intake tube.

12. A fuel injection system as defined by claim 9, in which said guide bore (4, 6) is embodied in a wall of the air intake tube.

* * * * *